US009053642B2

(12) United States Patent
Feagins et al.

(10) Patent No.: US 9,053,642 B2
(45) Date of Patent: Jun. 9, 2015

(54) SELF-SUPPORTING SIGN AND METHOD OF MANUFACTURING SAME

(71) Applicant: Ward Kraft, Inc., Fort Scott, KS (US)

(72) Inventors: Cecil J. Feagins, Fort Scott, KS (US); Cecil Lee Combs, Fort Scott, KS (US); Dustin Engle, Fort Scott, KS (US); Phillip Quick, Fort Scott, KS (US)

(73) Assignee: Ward Kraft, Inc., Fort Scott, KS (US)

( * ) Notice: Subject to any disclaimer, the term of this patent is extended or adjusted under 35 U.S.C. 154(b) by 0 days.

(21) Appl. No.: 14/031,801

(22) Filed: Sep. 19, 2013

(65) Prior Publication Data

US 2014/0013637 A1 Jan. 16, 2014

Related U.S. Application Data

(63) Continuation-in-part of application No. 13/566,669, filed on Aug. 3, 2012, which is a continuation-in-part of application No. 12/984,419, filed on Jan. 4, 2011, now Pat. No. 8,601,727.

(60) Provisional application No. 61/308,662, filed on Feb. 26, 2010, provisional application No. 61/348,389, filed on May 26, 2010.

(51) Int. Cl.
*G09F 7/00* (2006.01)
*G09F 1/06* (2006.01)

(52) U.S. Cl.
CPC ... *G09F 7/00* (2013.01); *G09F 1/06* (2013.01)
USPC ..... 40/606.01; 40/124.16; 40/539

(58) Field of Classification Search
USPC ..... 40/124.09, 124.16, 124.17, 124.18, 40/124.14, 539, 606.15, 777, 606.01, 40/124.08, 611.13; 116/63 P
See application file for complete search history.

(56) References Cited

U.S. PATENT DOCUMENTS

| | | | | |
|---|---|---|---|---|
| 1,669,782 | A | 5/1928 | Risser | |
| 1,821,025 | A | 9/1931 | Ohlson | |
| 2,270,763 | A * | 1/1942 | Nofziger | 40/124.18 |
| 3,624,688 | A | 11/1971 | Miller | |
| 5,303,668 | A | 4/1994 | Huang | |
| 5,564,208 | A | 10/1996 | Bergman | |
| 2005/0172529 | A1 | 8/2005 | Bourgoin et al. | |

OTHER PUBLICATIONS

U.S. Appl. No. 12/984,419 Office Action dated Dec. 3, 2012, 10 pages.
U.S. Appl. No. 12/984,419 Response to Office Action filed Feb. 13, 2013, 26 pages.

(Continued)

*Primary Examiner* — Joanne Silbermann
(74) *Attorney, Agent, or Firm* — Lathrop & Gage, LLP

(57) ABSTRACT

A self-supporting sign of unitary construction comprises a middle portion having a first side, a second side, an upper side, and a lower side. A first foldable flap extends from the first side at a first distance beneath the upper side. A second foldable flap extends from the second side at a second distance beneath the upper side. A front foldable portion having a rounded perimeter extends from the lower side. In a use configuration, the middle portion forms an obtuse angle with respect to the front portion. A first slit is provided adjacent the first side and a second slit is provided adjacent the second side. The first and second slits are configured to aid in the respective folding of the first flap and the second flap with respect to the middle portion.

20 Claims, 11 Drawing Sheets

(56) References Cited

OTHER PUBLICATIONS

U.S. Appl. No. 12/984,419 Office Action dated Jul. 24, 2013, 6 pages.
U.S. Appl. No. 12/984,419 Response to Office Action filed Aug. 29, 2013 7 pages.
U.S. Appl. No. 12/984,419 Notice of Allowance dated Sep. 9, 2013, 6 pages.
U.S. Appl. No. 13/566,669 Office Action dated Mar. 7, 2014, 14 pages.
U.S. Appl. No. 13/566,669 Notice of Allowance dated Jul. 23, 2014, 10 pages.

* cited by examiner

SELF-SUPPORTING SIGN AND METHOD OF MANUFACTURING SAME

CROSS-REFERENCE TO RELATED APPLICATIONS

This application is a continuation-in-part of U.S. patent application Ser. No. 13/566,669, filed Aug. 3, 2012, which is a continuation-in-part of U.S. patent application Ser. No. 12/984,419, filed Jan. 4, 2011, which claims priority to U.S. Provisional Patent Application Ser. No. 61/308,662, filed Feb. 26, 2010, and U.S. Provisional Patent Application Ser. No. 61/348,389, filed May 26, 2010. Priority is claimed to each of these applications, and the contents of each are incorporated herein by reference in their entirety.

BACKGROUND OF THE INVENTION

The invention relates generally to the field of signs. More particularly, the invention relates to the field of self-supporting signs such as those used in retail and corporate environments.

The prior art includes, for example, signs 10, 20 such as those shown in FIGS. 1 through 2*b*. While presumably sufficient for their intended purpose, the prior art signs 10, 20 suffer from various shortcomings. For example, the sign 10 requires use of a support 12 coupled to a base 11, and printed material 13 cannot stand on its own; it must be inserted in the support 12 (shown by arrow 15). The sign 20 can stand without having a separable base. However, to use the sign 20, the sign must first be folded about fold lines 21, 22, 23, and lower portions 24*a*, 24*b* must be coupled together (e.g., using adhesive, by mating tab 25*a* to slot 25*b*, et cetera). Further, because of its configuration, relatively large amounts of material may be required to construct the sign 20.

SUMMARY

Self-supporting signs and methods of making same are disclosed herein. According to one embodiment, a self-supporting sign of unitary construction comprises a middle portion having a first side, a second side, an upper side, and a lower side. A first foldable flap extends from the first side at a first distance beneath the upper side. A second foldable flap extends from the second side at a second distance beneath the upper side. A front foldable portion having a rounded perimeter extends from the lower side. In a use configuration, the middle portion forms an obtuse angle with respect to the front portion. A first slit is provided adjacent the first side and a second slit is provided adjacent the second side. The first and second slits are configured to aid in the respective folding of the first flap and the second flap with respect to the middle portion.

According to another embodiment, a self-supporting sign formed of a unitary sheet comprises a middle portion having a first side, a second side, an upper side, and a lower side. A first foldable flap extends from the first side at a first distance beneath the upper side, and is otherwise unrestrained. A second foldable flap extends from the second side at a second distance beneath the upper side, and is otherwise unrestrained. A front foldable portion having a rounded perimeter extends from the lower side. In a use configuration, the middle portion forms an obtuse angle with respect to the front portion. A first slit is provided adjacent the first side and a second slit is provided adjacent the second side. The first and second slits are configured to aid in the respective folding of the first flap and the second flap with respect to the middle portion. A third slit is provided adjacent the lower side. The third slit is configured to aid in the folding of the front portion with respect to the middle portion.

According to yet another embodiment, a self-supporting sign formed of a unitary sheet comprises a middle portion having a first side, a second side, an upper side, and a lower side. A first foldable flap extends from the first side at a first distance beneath the upper side. A second foldable flap extends from the second side at a second distance beneath the upper side. A front foldable portion having a rounded perimeter extends from the lower side. In a use configuration, the middle portion forms an obtuse angle with respect to the front portion. A first slit is provided adjacent the first side and a second slit is provided adjacent the second side. The first and second slits are configured to aid in the respective folding of the first flap and the second flap with respect to the middle portion. A third slit is provided adjacent the lower side. The third slit is configured to aid in the folding of the front portion with respect to the middle portion. The unitary sheet comprises a primary layer configured for the printing of indicia. The primary layer is coupled to a first laminate layer.

BRIEF DESCRIPTION OF THE SEVERAL VIEWS OF THE DRAWINGS

Illustrative embodiments of the present invention are described in detail below with reference to the attached drawing figures, wherein.

DETAILED DESCRIPTION

Figure 1:
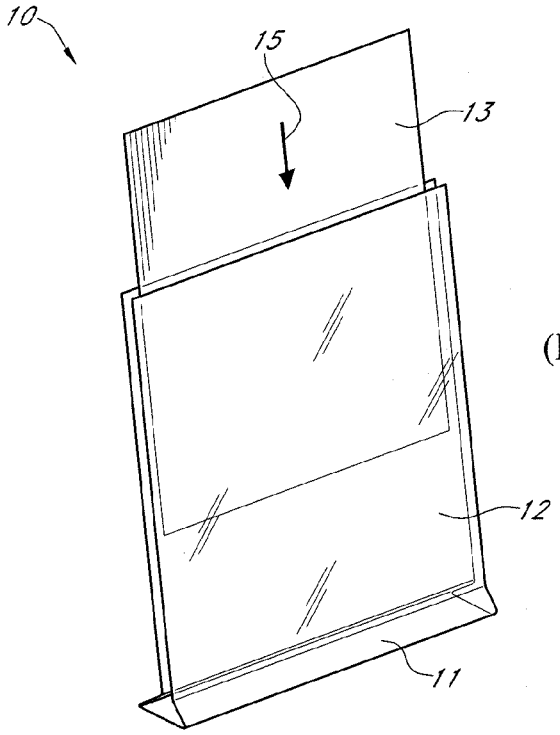
FIG. 1 (PRIOR ART)
FIG. 1 shows a perspective view of a PRIOR ART sign.
Figure 2A:
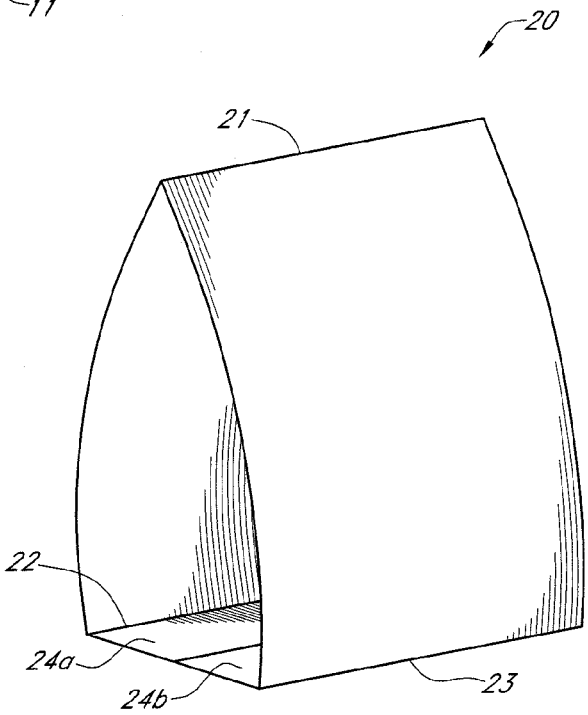
FIG. 2a (PRIOR ART)
FIG. 2*a* shows a perspective view of another PRIOR ART sign.
Figure 2B:
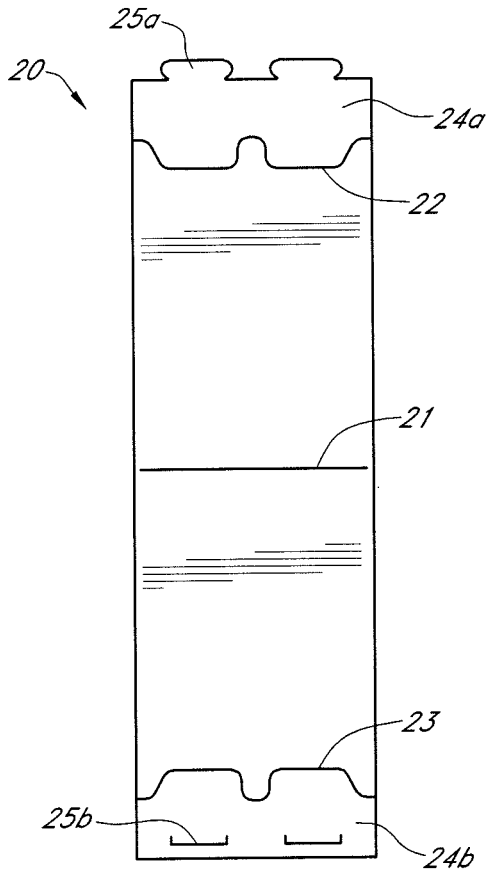
FIG. 2b (PRIOR ART)
FIG. 2*b* shows the PRIOR ART sign of FIG. 2 before being folded and secured.
Figure 3:
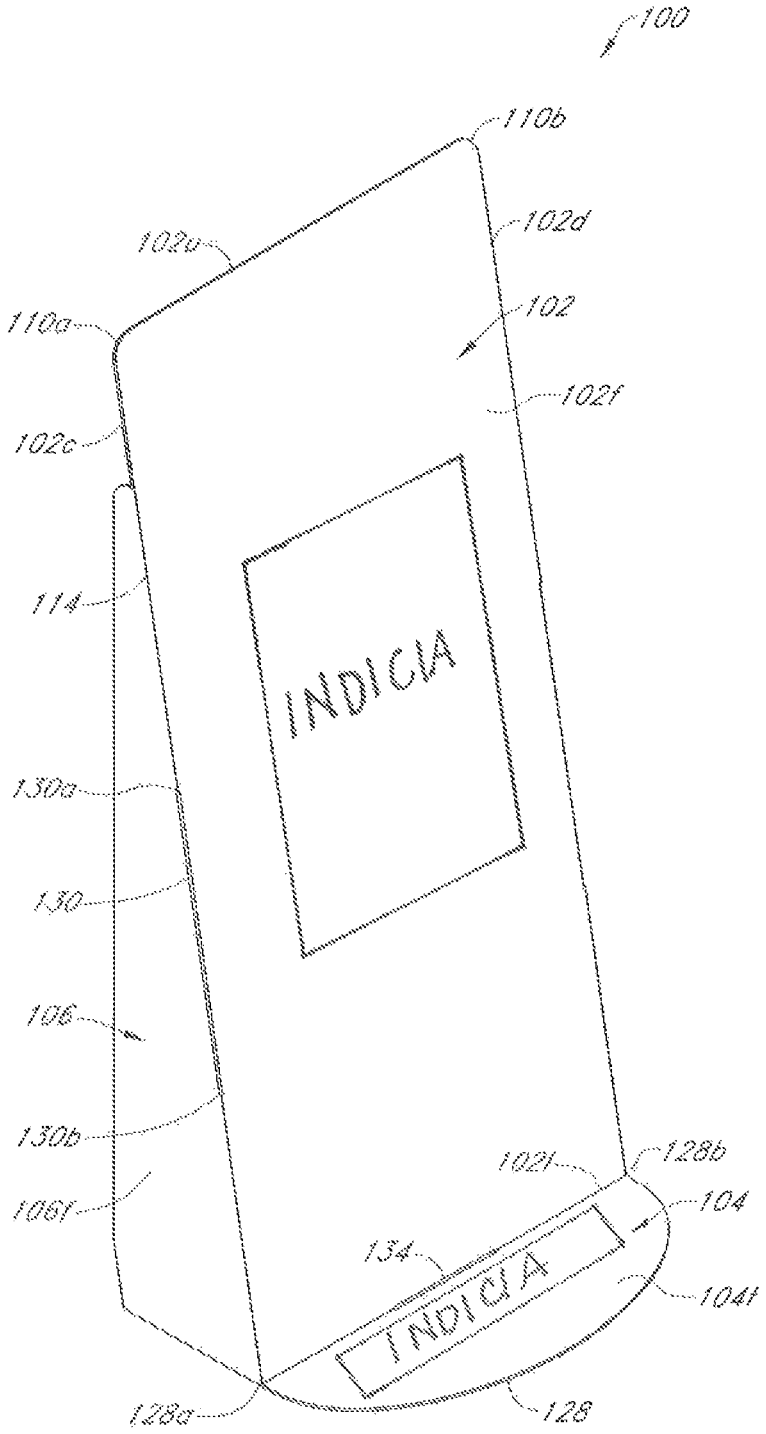
FIG. 3 shows a perspective view of a self-supporting sign according to an inventive embodiment, configured for use.
Figure 4:
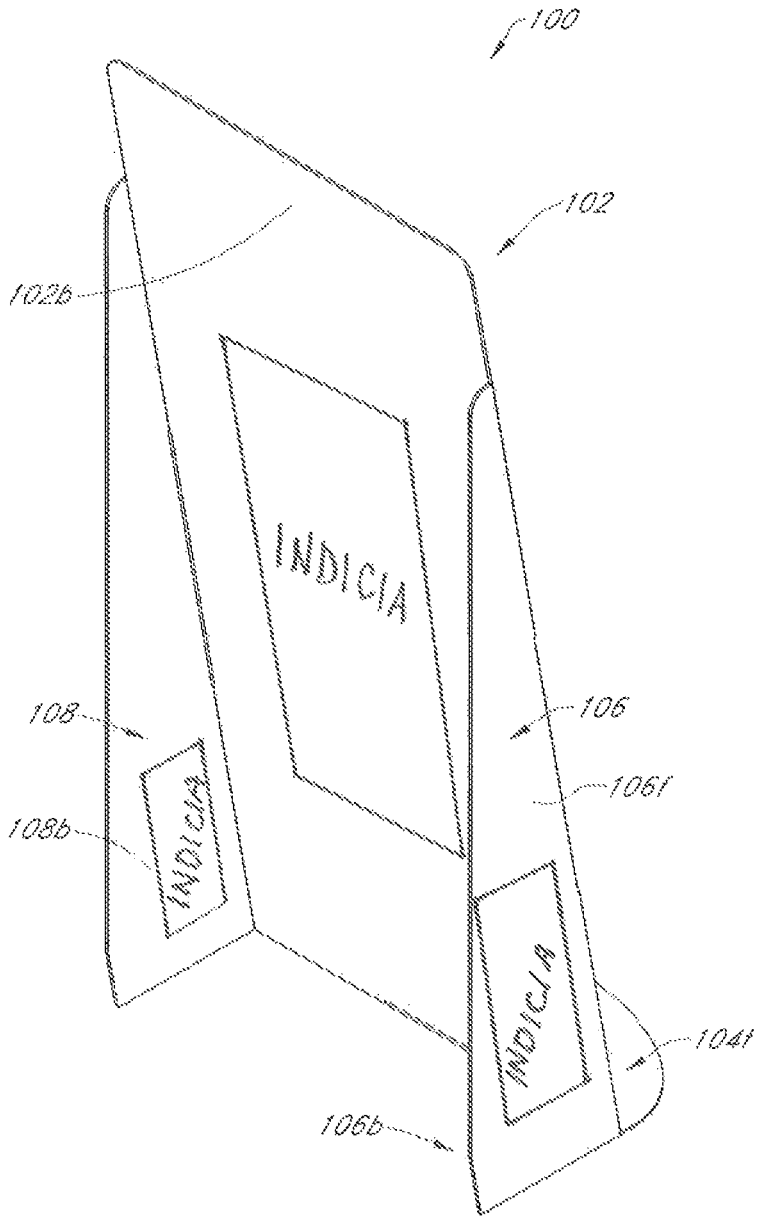
FIG. 4 shows another perspective view of the self-supporting sign of FIG. 3.
Figure 5:
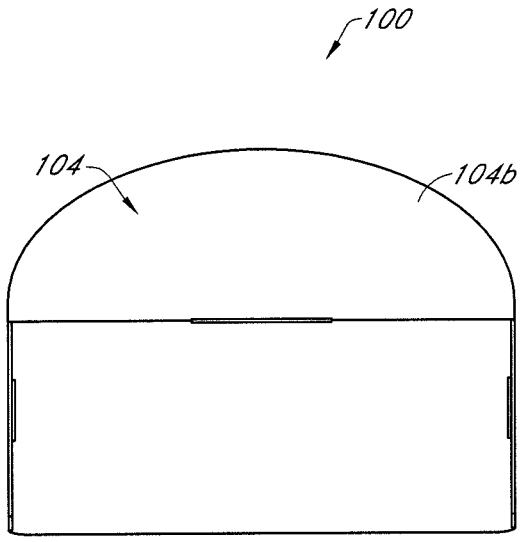
FIG. 5 shows a bottom view of the self-supporting sign of FIG. 3.
Figure 7:
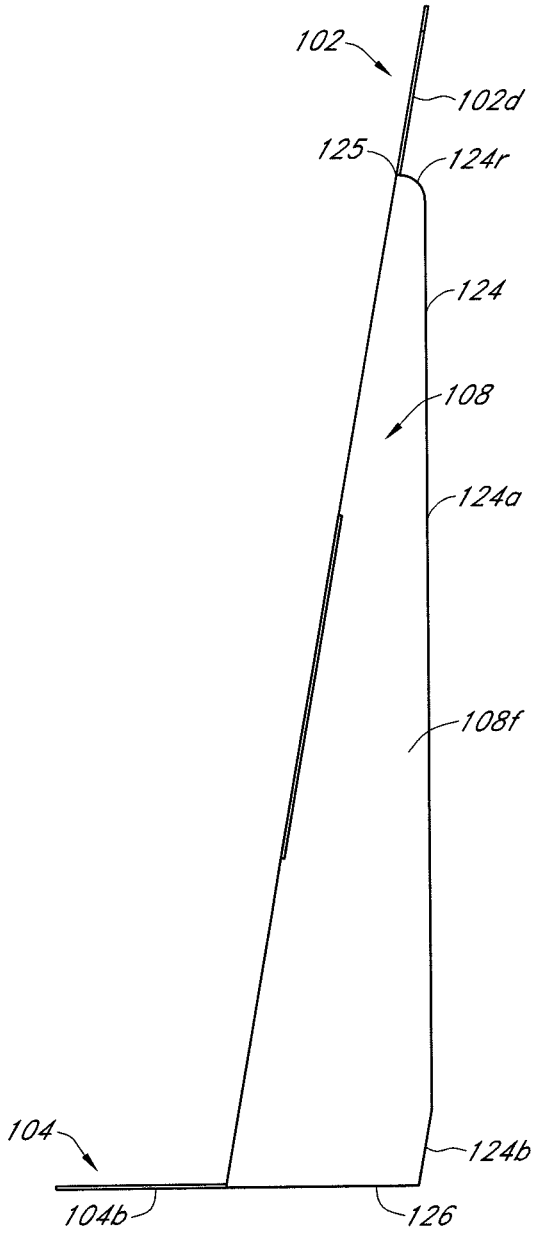
FIG. 7 shows a right side view of the self-supporting sign of FIG. 3.

Embodiments of the present invention provide self-supporting signs and methods of making same. FIG. 3 shows one embodiment 100 of a self-supporting sign in line with the teachings of the current invention. As can be seen, the sign 100 has a middle portion 102 having a front surface 102*f* and a back surface 102*b* (see FIG. 4), a front portion 104 having a top surface 104*t* and a bottom surface 104*b* (see FIG. 5), a first side portion (or "flap") 106 having a front surface 106*f* and a back surface 106*b* (see FIG. 4), and a second side portion (or "flap") 108 (see FIG. 4) having a front surface 108*f* (see FIG. 7) and a back surface 108*b*.

The middle portion 102 may be generally rectangular as shown, or of other regular or irregular shapes. The middle portion 102 may have an upper side 102*u*, a lower side 102*l*, a first side 102*c* and a second side 102*d*. A corner 110*a* formed at the intersection of the first side 102*c* and the upper side 102*u*, and a corner 110*b* formed at the intersection of the second side 102*d* and the upper side 102*u*, may both, in some embodiments, be rounded.

Figure 8:
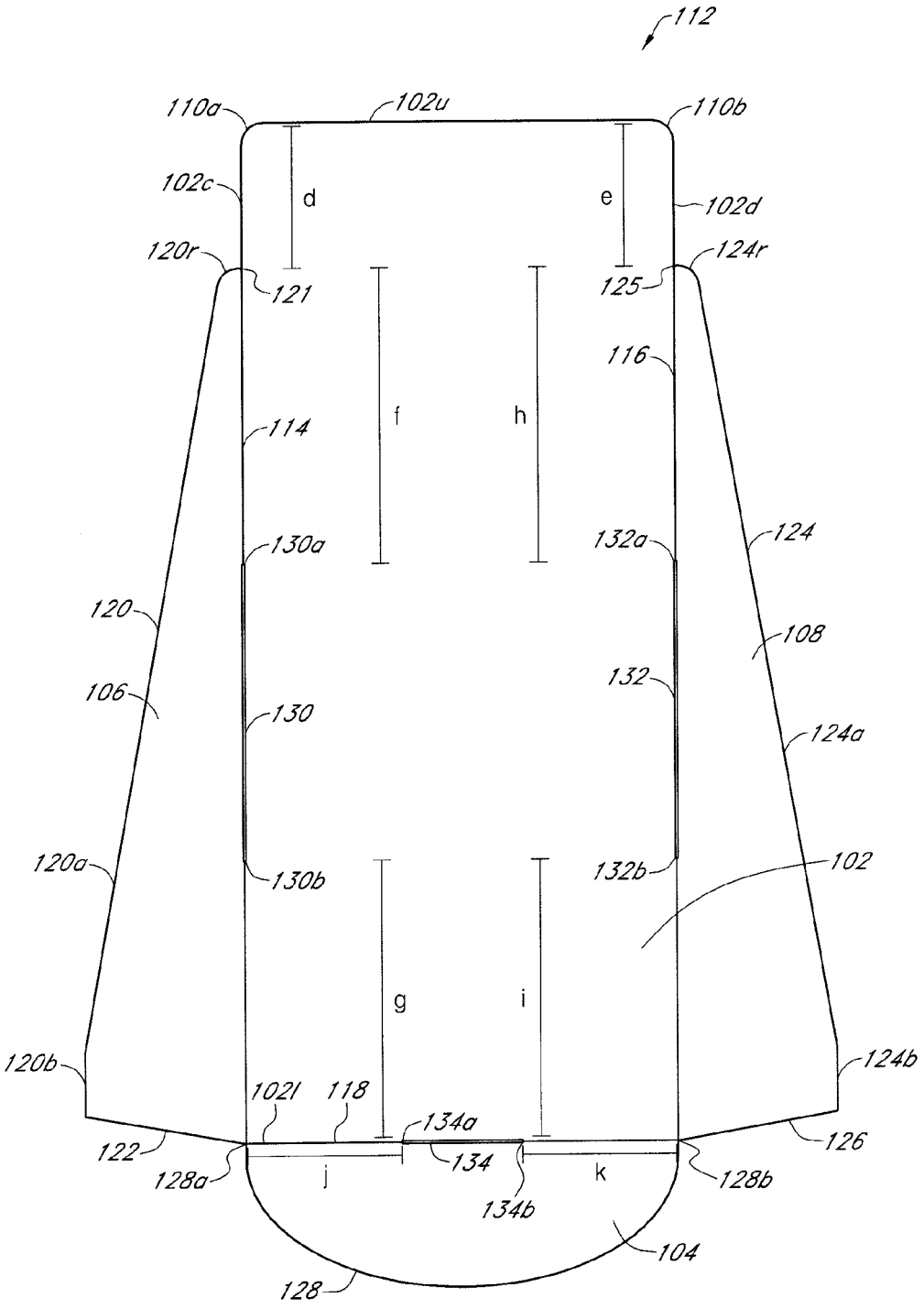
FIG. 8 shows a top view of the self-supporting sign of FIG. 3 before a first flap, a second flap, and a front portion are folded with respect to a middle portion.

The self-supporting sign 100 has a unitary construction of sheet 112 (see FIG. 8). The sheet 112 may have a first fold line 114 to distinguish the first side portion 106 from the middle portion 102, a second fold line 116 to distinguish the second side portion 108 from the middle portion 102, and a third fold line 118 to distinguish the front portion 104 from the middle portion 102. The first fold line 114 may be in line with and extend part of the length of the middle portion first side 102*c*, the second fold line 116 may be in line with and extend part of the length of the middle portion second side 102*d*, and the third fold line 118 may be in line with and extend the entire length of the middle portion lower side 102*l*.

Figure 6:
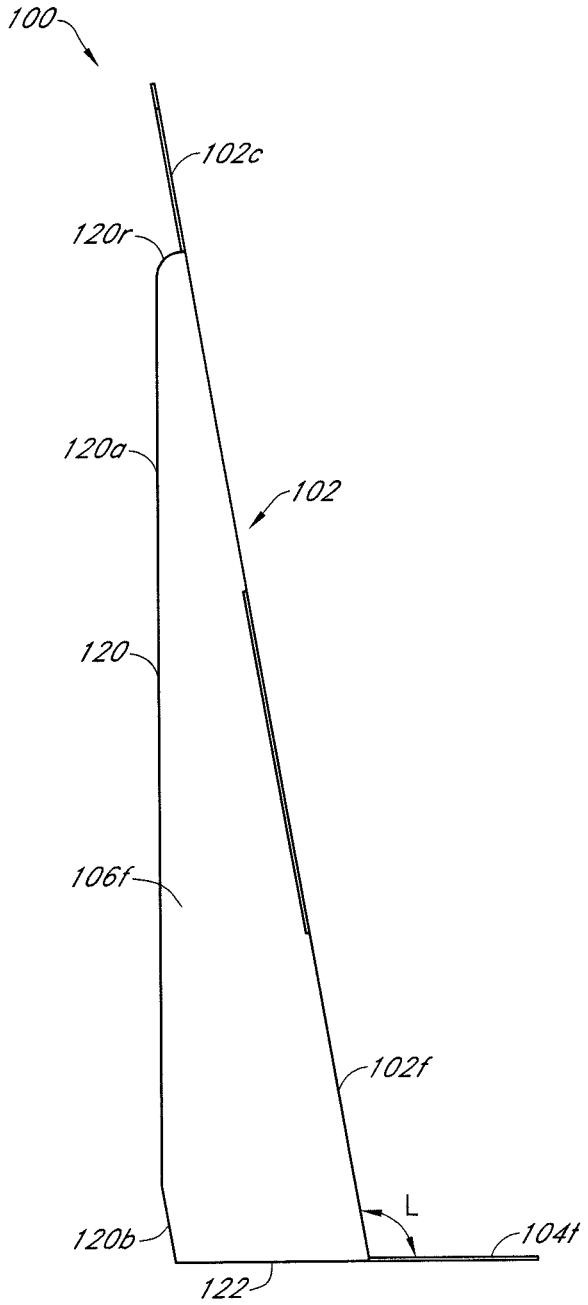
FIG. 6 shows a left side view of the self-supporting sign of FIG. 3.

The first flap 106 may have an outer edge 120 and a lower edge 122. The first flap outer edge 120 may have a rounded portion 120*r* having an end 121 adjacent the middle portion first side 102*c*. The rounded portion 120*r* may originate at the end 121, which, as shown in FIG. 8, may be a distance d beneath the middle portion upper side 102*u*. The first flap outer edge 120 may have a first angled portion 120*a* that extends outwards from the rounded portion 120*r* at an angle. The first flap outer edge 120 may also have a second angled portion 120*b* that extends slightly inwards from the first angled portion 120*a* (see FIG. 6) at an angle and terminates at the first flap lower edge 122. The first flap lower edge 122 may extend from the bottom of the second angled portion 120*b* to the bottom of the middle portion first side 102*c*.

The second flap 108 may similarly have an outer edge 124 and a lower edge 126. The second flap outer edge 124 may have a rounded portion 124*r* having an end 125 adjacent the middle portion second side 102*d*. The rounded portion 124*r* may originate at the end 125, which may be a distance e beneath the middle portion upper side 102*u*. The distances d and e may in some embodiments be equal. Akin to the first flap outer edge 120, the second flap outer edge 124 may have a first angled portion 124*a* that extends outwards from the rounded portion 124*r* at an angle. The second flap outer edge 124 may also have a second angled portion 124*b* that extends slightly inwards from the second flap first angled portion 124*a* (see FIG. 7) at an angle and terminates at the second flap lower edge 126. The second flap lower edge 126 may extend from the bottom of the second flap second angled portion 124*b* to the bottom of the middle portion second side 102*d*. In some embodiments, it may be particularly desirable for the first flap lower edge 122 to not be collinear with the middle portion lower side 102*l*, and for the second flap lower edge 126 to not be collinear with the middle portion lower side 102*l*. However, the lower edges 122, 126 may be offset relative to the middle portion lower side 102*l* by generally the same amount (e.g., five to twenty degrees).

The front portion 104 may extend from the lower side 102*l* of the middle portion 102. As can be seen in the figures, the front portion 104 may have a semi-oval shape, and have a generally rounded outer edge 128 having a first end 128*a* adjacent the middle portion first side 102*c* and a second end 128*b* adjacent the middle portion second side 102*d*.

A first slit 130 (see FIG. 8) having a first end 130*a* and a second end 130*b* may be cut out along the first fold line 114. While not required, a distance f between the first slit first end 130*a* and the first flap rounded portion end 121 may be generally equal to a distance g between the first slit second end 130*b* and the middle portion lower side 102*l*. A second slit 132 having a first end 132*a* and a second end 132*b* may be cut out along the second fold line 116. A distance h between the second slit 132 first end 132*a* and the second flap rounded portion end 125 may be generally equal to a distance i between the second slit second end 132*b* and the middle portion lower side 102*l*. At least in some embodiments, the distances f, g, h, and i may all be generally equal.

A third slit 134 having a first end 134*a* and a second end 134*b* may be cut out along the third fold line 118. A distance j between the third slit first end 134*a* and the first fold line 114 may, in some embodiments, be equal to a distance k between the third slit second end 134*b* and the second fold line 116.

Figure 9:
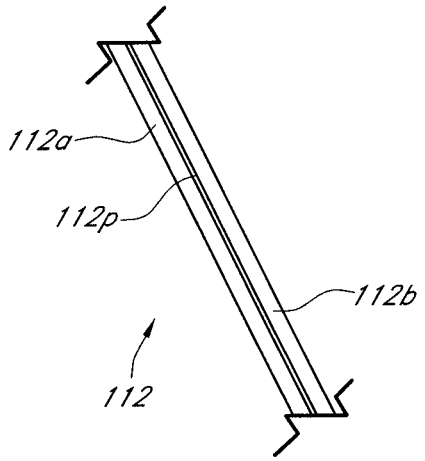
FIG. 9 shows a cross sectional view of a portion of the self-supporting sign of FIG. 3.

As shown in FIG. 9, the sheet 112 may include a primary layer 112*p*, a first laminate layer 112*a*, and a second laminate layer 112*b*, such that the primary layer 112*p* is located between the laminate layers 112*a*, 112*b*. The primary layer 112*p* may be, for example, a synthetic printing substrate (e.g., the product marketed under the name Teslin® by PPG industries of Monroeville, Pa.), another printing substrate, or any other appropriate foldable material (e.g., plastics, paper, et cetera). The laminate layers 112*a*, 112*b* may be, for example, 10 mil gloss laminate, or any other appropriate laminating material. Importantly, the primary layer 112*p* and the laminate layer(s) 112*a*, 112*b* must collectively be sufficiently rigid such that the middle portion 102 and the flaps 106, 108 remain in a raised position upon folding, as discussed in more detail below. Though not shown in the figures, it may also be acceptable for multiple laminate layers 112*a*, 112*b* to be used on either or both sides of the primary layer 112*p* (e.g., such that sheet 112 two laminate layers 112*a* coupled atop one another), and for multiple primary layers 112*p* to be included (e.g., adhered to one another). Especially if laminate layers 112*a*, 112*b* are included, it may be desirable for indicia to be placed on the primary layer 112*p* (e.g., using a digital press, cold fusion printing, or any other appropriate method) before the laminate layers 112*a*, 112*b* are adhered to the primary layer 112*p*.

Figure 10:
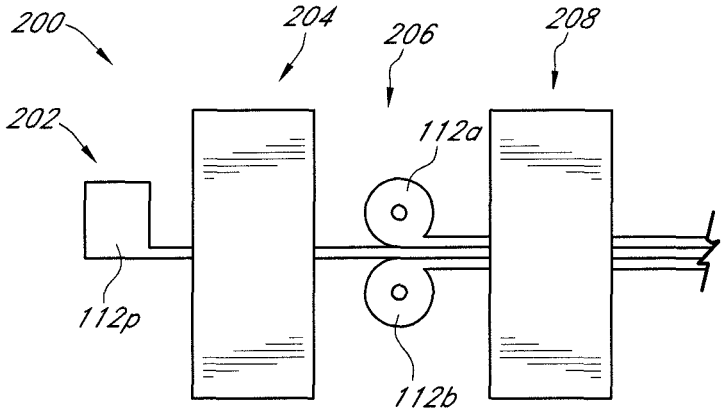
FIG. 10 shows a schematic representation of a manufacturing process for the self-supporting sign of FIG. 3.

FIG. 10 shows a schematic representation of a manufacturing process 200 for the self-supporting sign 100. At a first step 202, the primary layer 112*p* is provided (e.g., as a sheet or roll). The process 200 proceeds from step 202 to step 204.

At step 204, indicia is added to the primary layer 112*p* (i.e., to one side or both sides of the primary layer 112*p*), such as through a digital press or any other appropriate method. It may be particularly important for any desired indicia to be added before the primary layer 112*p* is coupled to the laminate layers 112*a*, 112*b*, though indicia may be added in some embodiments after the primary layer 112*p* is coupled to the laminate layers 112*a*, 112*b*. The process 200 proceeds from step 204 to step 206.

At step 206, the laminate layers 112*a*, 112*b* are coupled to the opposite sides of the primary layer 112*p*, such as by pressure sensitive adhesive. The laminate layers 112*a*, 112*b* may be obtained already having pressure sensitive adhesive, or pressure sensitive adhesive may otherwise be applied to the primary layer 112*p* and/or the laminate layers 112*a*, 112*b*. Though the adhesive is not shown in the drawings, those skilled in the art will appreciate that it is present nevertheless. The process 200 proceeds from step 206 to step 208.

At step 208, the primary layer 112*p* and the laminate layers 112*a*, 112*b* are die cut, defining the self-supporting sign 100 (i.e., its perimeter and also the slits 130, 132, and 134). Simultaneously, or in a further step, the first, second, and third fold lines 114, 116, and 118, respectively, may be defined through pressure that does not cut through the sheet 112. In some embodiments, the fold lines 114, 116, 118 may not be defined through the manufacturing process.

To use the self-supporting sign 100 (i.e., in a "use configuration"), first flap 106 may be folded along the first fold line 114 such that the back surface 106*b* of the first flap 106 and the back surface 102*b* of the middle portion 102 are generally perpendicular to each other. The second flap 108 may similarly be folded along the second fold line 116 such that the back surface 108*b* of the second flap 108 and the back surface 102*b* of the middle portion 102 are generally perpendicular to each other, and the back surfaces 106*b*, 108*b* of the first and second flaps 106, 108 face each other. Either before or after the flaps 106, 108 are so folded, the front portion 104 may be folded along the third fold line 118 such that an obtuse angle L (see FIG. 6) is formed between the front portion top surface 104*t* and the middle portion front surface 102*f*. The angle L may be, for example, between 100 degrees and 150 degrees. It has been found that the first, second, and third slits 130, 132, and 134 significantly increase the ease with which the first flap 106, the second flap 108, and the top portion 104, respectively, can be folded in their proper positions with respect to the middle portion 102. People of skill in the art will appreciate that the first, second, and third slits 130, 132, 134 have been exaggerated in the figures for illustrative purposes, and that these slits 130, 132 and 134 may not be readily apparent or detract from the appearance of a folded sign 100.

The sign 100 may then be stood upright on the ground or another surface (e.g., a table, a counter, et cetera) such that at least part of the lower edge 122 of the first flap 106, the lower edge of the 126 of the second flap 108, and the bottom surface 104*b* of the front portion 104 are in contact with the surface. Notably, the flaps 106, 108 do not lock into (or otherwise directly interact with) any portion apart from the middle portion 102. The first flap second angled portion 120*b* and the second flap second angled portion 124*b* may provide structural integrity and also help the sign 100 to remain upright. As noted above, indicia (e.g., advertisements, special offers, et cetera) may be provided on the front and back surfaces 102*f*, 102*b*, of the middle portion 102, the front and back surfaces 106*f*, 106*b*, of the first flap 106, the front and back surfaces 108*f*, 108*b* of the second flap 108, and/or at least the top surface 104*t* of the front portion 104.

Figure 11:
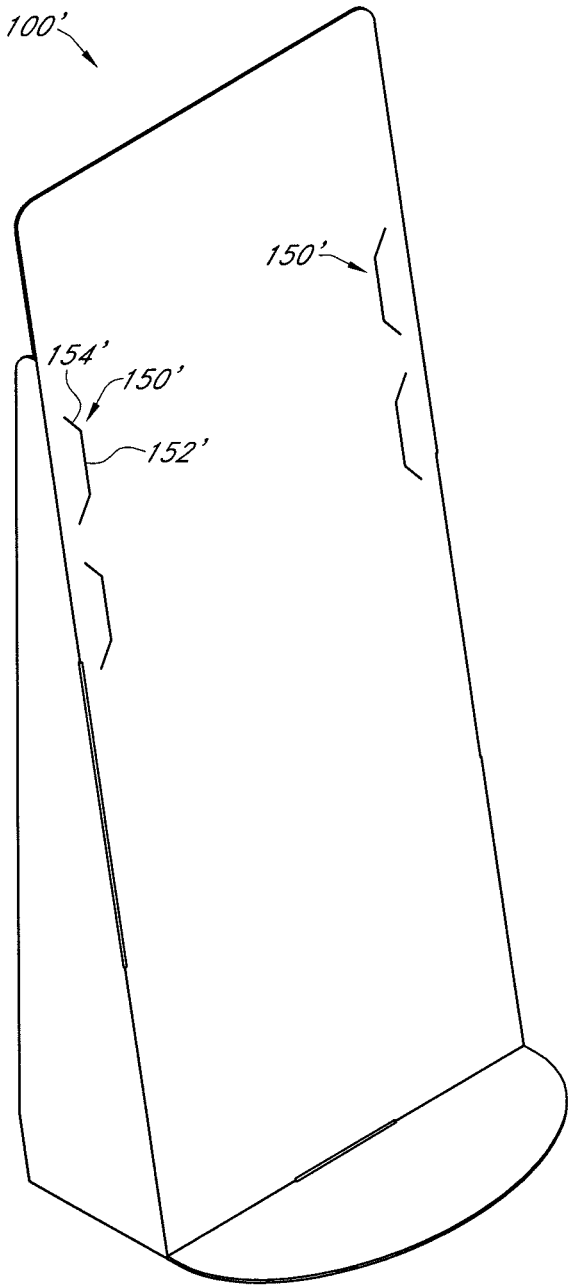
FIG. 11 shows a perspective view of another embodiment of the self-supporting sign of FIG. 3.

FIG. 11 shows an alternate embodiment 100' of the sign 100 that is substantially similar to the embodiment 100, except as specifically noted and/or shown, or as would be inherent. Further, those skilled in the art will appreciate that the embodiment 100 (and thus the embodiment 100') may be modified in various ways, such as through incorporating all or part of the disclosure provided herein. For uniformity and brevity, corresponding reference numbers may be used to indicate corresponding parts, though with any noted deviations. The main difference between the sign 100' and the sign 100 is that the sign 100' may include one or more pairs of opposed retaining members 150' on the front surface 102*f* (and/or the back surface 102*b* of the middle portion 102, and/or the front or back surfaces 106*f*, 106*b*, 108*f*, 108*b* of the first flap 106 and the second flap 108, respectively). The retaining members 150' may allow for a business card, flyer, advertisement, coupon, invitation, memo, announcement, pad of paper, or other item to be coupled to the sign 100 by being held between one or both of the retaining members 150'. The retaining members 150' may for example be formed through a die cutting process (either at step 208 or another step) and may have a generally vertical portion 152' leading to angled portions 154' (as shown), or may be other shapes that allow the retaining function to be accomplished. Retaining members 150' may also or alternatively be provided on the top surface 104*t* of the front portion 104.

Thus, as has been described, the unique configuration and distinctive appearance of the self-supporting sign 100 makes it a prime vehicle for placing advertisements and other indicia, and minimizes the costs of materials associated with creating pop-up signs. Many different arrangements (including aesthetic arrangements) of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A self-supporting sign of unitary construction, comprising:

a middle portion having a first side, a second side, an upper side, and a lower side;

a first foldable flap, the first flap extending from the first side at a first distance beneath the upper side;

a second foldable flap, the second flap extending from the second side at a second distance beneath the upper side; and a front foldable portion, the front portion extending from the lower side and having a rounded perimeter;

wherein:

in a use configuration, the middle portion forms an obtuse angle with respect to the front portion;

a first slit is provided adjacent the first side and a second slit is provided adjacent the second side, the first and second slits configured to aid in the respective folding of the first flap and the second flap with respect to the middle portion;

a third slit is provided adjacent the lower side to aid in the folding of the front foldable portion with respect to the middle portion; and in the use configuration:

the first foldable flap directly touches only the middle portion and a surface upon which the self-supporting sign rests; and the second foldable flap directly touches only the middle portion and the surface.

2. The self-supporting sign of claim 1, wherein:

the middle portion is generally rectangular; and the first foldable flap comprises a first rounded portion, a first angled portion, and a second angled portion.

3. The self-supporting sign of claim 2 wherein:

the first angled portion is adjacent the first rounded portion and extends away from the middle portion; and the portion is adjacent the first angled portion and extends towards the middle portion.

4. The self-supporting sign of claim 2, wherein the middle portion comprises a plurality of retaining members.

5. The self-supporting sign of claim 4, wherein the retaining members are configured to hold an item from the list consisting of: business cards, flyers, advertisements, coupons, invitations, memos, announcements, and pads of paper.

6. The self-supporting sign of claim 2, wherein the middle portion includes a first rounded corner and a second rounded corner.

7. The self-supporting sign of claim 6, wherein a length of the third slit is less than a length of the lower side.

8. The self-supporting sign of claim 1, wherein the sign is formed of a unitary sheet, and wherein the unitary sheet comprises a primary layer coupled to a first laminate layer.

9. The self-supporting sign of claim 8, wherein the unitary sheet further comprises a second laminate layer coupled to the primary layer, the primary layer being between the first and second laminate layers.

10. The self-supporting sign of claim 9, wherein in the use configuration the obtuse angle is between about 100 degrees and about 150 degrees.

11. The self-supporting sign of claim 10, wherein a length of the first slit is generally equal to a length of the second slit.

12. The self-supporting sign of claim 11, wherein:

the first distance is generally equal to the second distance; and the length of the first slit is greater than the first distance.

13. The self-supporting sign of claim 8, wherein the primary layer is configured for the printing of indicia.

14. The self-supporting sign of claim 2, wherein the second foldable flap comprises a first rounded portion, a first angled portion, and a second angled portion.

15. The self-supporting sign of claim 14, wherein indicia is provided on a front surface of the middle portion and a back surface of the middle portion.

16. The self-supporting sign of claim 15, wherein indicia is provided on a front and back surface of the first and second foldable flaps, and a top surface of the front portion.

17. The self-supporting sign of claim 14, wherein the first foldable flap further has a lower edge extending from a bottom of the first foldable flap second angled portion to the middle portion second side, and wherein the lower edge is collinear with the middle portion lower side.

18. The self-supporting sign of claim 17, wherein the second foldable flap further has a lower edge extending from the bottom of the second foldable flap second angled portion to the middle portion second side, and wherein the lower edge is collinear with the middle portion lower side.

19. The self-supporting sign of claim 18, wherein the lower edge of the first foldable flap is not collinear with the middle portion, and is offset relative to the middle portion lower side by an angle between about five degrees and about twenty degrees.

20. The self-supporting sign of claim 18, wherein the lower edge of the second foldable flap is offset an amount relative to the middle portion lower side generally equal to the first foldable flap.

* * * * *